United States Patent [19]

Kondo et al.

[11] Patent Number: 4,467,162

[45] Date of Patent: Aug. 21, 1984

[54] EXCITING ARRANGEMENT FOR INDUCTION HEATING PROCESS

[75] Inventors: Shigeki Kondo, Tachikawa; Yoshio Yamazaki, Saitama; Tomofumi Iketani, Fuchu; Keiichiro Doi, Izumi; Seiji Tanaka, Yamatokoriyama, all of Japan

[73] Assignees: Riccar Co., Ltd., Tokyo; Sharp Kabushiki Kaisha, Osaka, both of Japan

[21] Appl. No.: 555,417

[22] Filed: Nov. 28, 1983

Related U.S. Application Data

[63] Continuation of Ser. No. 270,104, Jun. 3, 1981, abandoned.

[30] Foreign Application Priority Data

Jun. 13, 1980 [JP] Japan ..... 55-80436

[51] Int. Cl.[3] ..... H05B 6/12

[52] U.S. Cl. ..... 219/10.49 R; 219/10.79; 219/10.67

[58] Field of Search ..... 219/10.49 R, 10.75, 219/10.77, 10.79, 10.67, 10.43

[56] References Cited

U.S. PATENT DOCUMENTS

| | | | |
|---|---|---|---|
| 3,710,062 | 1/1973 | Peters, Jr. | 219/10.49 R |
| 3,781,503 | 12/1973 | Harnden, Jr. et al. | 219/10.49 R |
| 3,947,652 | 3/1976 | Cobb | 219/10.79 |
| 3,989,916 | 11/1976 | Amagami et al. | 219/10.49 R |
| 3,996,442 | 12/1976 | Moreland et al. | 219/10.49 R |
| 4,092,511 | 5/1978 | Austin | 219/10.49 R |
| 4,348,571 | 9/1982 | Dills | 219/10.49 R |

*Primary Examiner*—Roy N. Envall, Jr.
*Assistant Examiner*—Philip H. Leung
*Attorney, Agent, or Firm*—Birch, Stewart, Kolasch & Birch

[57] ABSTRACT

An improved exciting arrangement for an induction heating apparatus which includes a heating coil disposed in a spaced relation between a top plate for placing a vessel of magnetizable material to be heated and a bottom plate, so as to be impressed with high frequency current, a shielding plate member of non-magnetizable metallic material disposed in a space between the heating coil and the bottom plate, and a coil support member of highly magnetizable material providing a high electrical resistance, disposed between the heating coil and the shielding plate so as to cover part of the peripheral portion of the heating coil.

10 Claims, 4 Drawing Figures

EXCITING ARRANGEMENT FOR INDUCTION HEATING PROCESS

This application is a continuation of application Ser. No. 270,104 filed on June 3, 1981, now abandoned.

BACKGROUND OF THE INVENTION

The present invention generally relates to an induction heating apparatus and more particularly, to an improved exciting arrangement for an induction heating apparatus.

Conventionally, in the induction heating apparatuses generally employed, for example, for cooking purposes and the like, it has been so arranged that, as shown in FIG. 1, an induction heating coil M is disposed adjacent to and below the under surface of a top or upper plate P1 which is made of ceramic material or the like, and on which a vessel or container V made of magnetizable material is placed, so that, by causing high frequency current to flow through said heating coil M, alternating magnetic lines of flux are produced from the heating coil M for induction heating of the vessel V and an object to be heated (not shown) accommodated therein.

In the above case, if a bottom plate P2 made of iron or the like is sufficiently spaced from the heating coil M, no particular problems will be invited but, should the bottom plate P2 be disposed close to the lower portion of the heating coil M, the alternating magnetic lines of flux penetrate or pass through the bottom plate P2 as shown by dotted lines in FIG. 1, and thus, the vessel V and the bottom plate P2 are undesirably heated simultaneously, both acting as loads, with consequent reduction of heating efficiency with respect to the vessel V. Furthermore, upon heating of the bottom plate P2, electronic parts, etc. (not shown) mounted on said bottom plate P2 are adversely affected, while the alternating magnetic lines of flux generated by the heating coil M also exert unfavorable influence on electronic circuits (not shown) incorporated in the heating apparatus, thus resulting in malfunctions thereof.

Therefore, the distance between the top plate P1 and the bottom plate P2 is consequent limited, and thus, from the fact that the height of the heating apparatus can not be made excessively low, efficient operation of the apparatus, for example, during cooking has been undesirably impaired.

In order to eliminate the disadvantage as described above, there has conventionally been proposed an arrangement in which a bar member of ferrite material is attached to the lower portion of the heating coil, but no appreciable effect has been achieved thereby.

In another prior art disclosed, for example, in U.S. Pat. No. 3,710,062 patented Jan. 9, 1973, it is so arranged that a metallic support plate of aluminum is provided below a heating coil or alternatively the heating coil is acommodated in a ferrite core member. However, even by the known arrangement as described above, the disadvantages as stated earlier are not fully eliminated, still presenting some inconvenience in the actual applications.

SUMMARY OF THE INVENTION

Accordingly, an essential object of the present invention is to provide an improved exciting arrangement for an induction heating apparatus which is highly efficient in use and free from adverse effects to internal electronic parts and circuits.

Another important object of the present invention is to provide an improved exciting arrangement of the above described type which is simple in construction and stable in functioning, and is capable of presenting an induction heating apparatus compact in size and highly efficient in use.

A further object of the present invention is to provide an improved exciting arrangement of the above described type which can readily be incorporated into induction heating apparatuses of various kinds at low cost.

In accomplishing these and other objects, according to one preferred embodiment of the present invention, there is provided an exciting arrangement for an induction heating apparatus which includes a heating coil coupled to a power source and disposed in a spaced relation between a top plate for placing thereon a vessel of magnetizable material to be heated and a bottom plate, so as to be impressed with high frequency current, a shielding plate member of non-magnetizable metallic material disposed in a space between the heating coil and the bottom plate, and a coil support member of highly magnetizable material providing a high electrical resistance, disposed between the heating coil and the shielding plate so as to cover part of the peripheral portion of the heating coil, with the shielding plate member being held in contact with the lower portion of said coil support member.

By the construction according to the present invention as described above, an improved exciting arrangement for an induction heating apparatus has been advantageously presented, with substantial elimination of disadvantages inherent in the conventional exciting arrangements of this kind.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
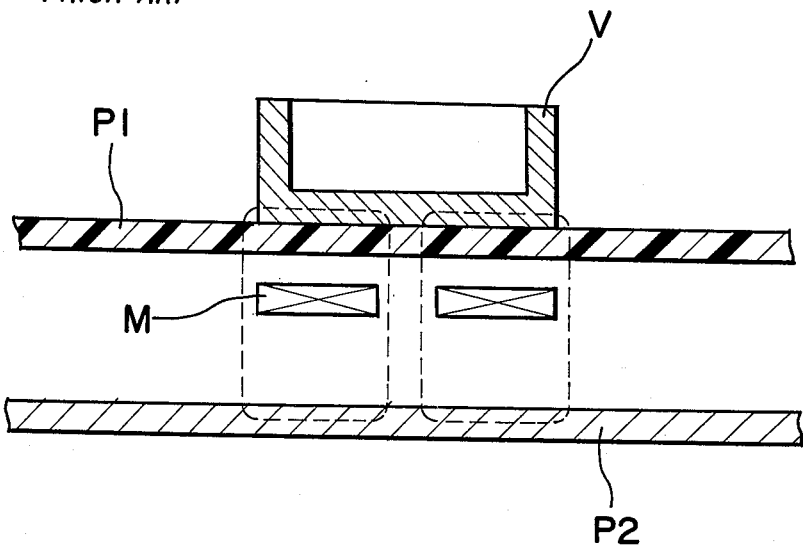
Fig. 1 PRIOR ART
FIG. 1 is a fragmentary side sectional view schematically showing a conventional exciting arrangement for an induction heating apparatus (already referred to)
Figure 2:
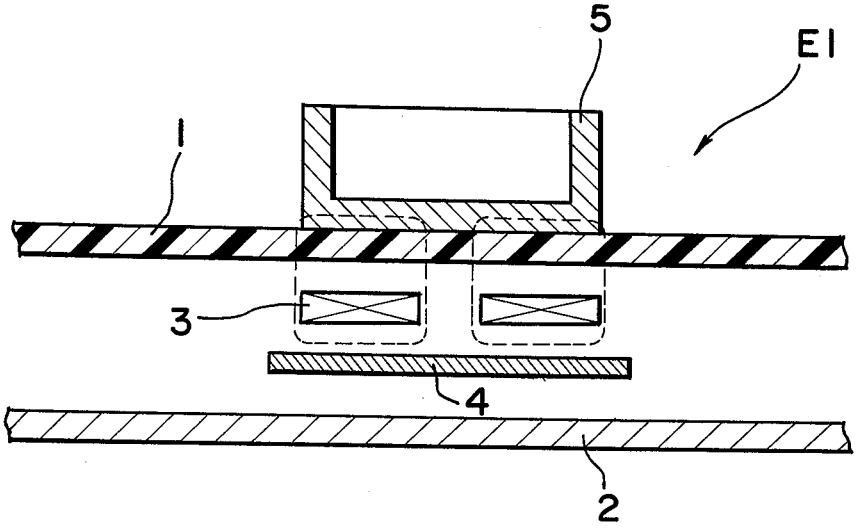
FIG. 2 is a view similar to FIG. 1, which particularly shows an improved exciting arrangement for an induction heating apparatus according to one preferred embodiment of the present invention.

Referring now to the drawings, there is shown in FIG. 2 an improved exciting arrangement E1 for an induction heating apparatus according to one preferred embodiment of the present invention. The improved exciting arrangement E1 generally includes an induction heating coil 3 coupled to a suitable power source (not shown) and disposed in a spaced relation between a top plate 1 made of ceramic material or the like and a bottom plate 2 of iron material for the induction heating apparatus, and a shielding plate member 4 of non-magnetizable metallic material such as aluminum or the like disposed below and adjacent to the lower portion of the heating coil 3 in a space between said heating coil 3 and said bottom plate 2 as shown, with a vessel or container 5 of magnetizable material being placed on the upper surface of said top plate 1 for accommodating therein an object to be heated (not shown).

It is to be noted here that the plate member 4 as described above may be formed into any desired configurations such as rectangular and circular shapes, etc., so far as it has a size sufficient for covering the under surface of the heating coil 3.

By the above arrangement, when the high frequency current is caused to flow through the heating coil 3, the plate member 4 of non-magnetizable material shows a magnetic reluctance considerably higher than that of air, without any penetration of the magnetic lines of flux therethrough, and therefore, said magnetic lines of flux reach the vessel 5 through the lower portion of the heating coil 3 for heating said vessel 5 and the object to be heated accommodated therein.

Accordingly, in the exciting arrangement E1 according to the present invention as described above, the disadvantages inherent in the conventional exciting arrangements such as the undesirable heating of the bottom plate, adverse effects to the electronic parts and electronic circuits due to heating of the bottom plate, and malfunctions resulting therefrom, etc. may be completely eliminated.

Figure 3:
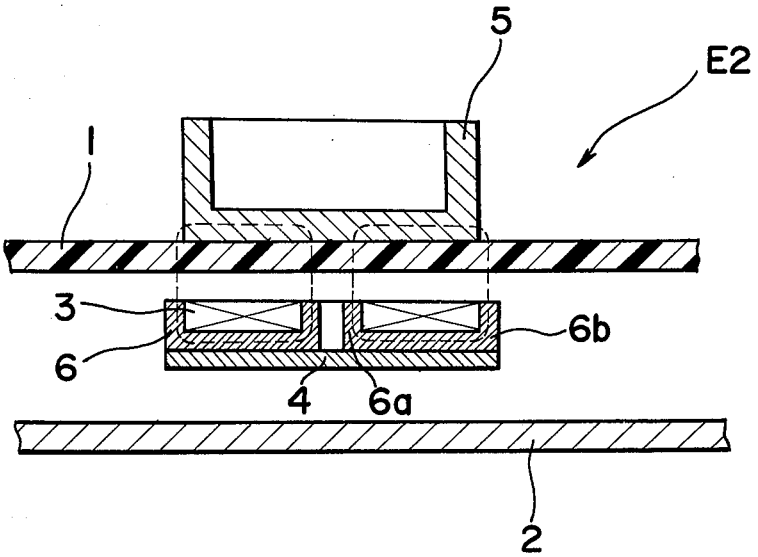
FIG. 3 is a view similar to FIG. 2, which particularly shows a modification thereof.
Figure 4:
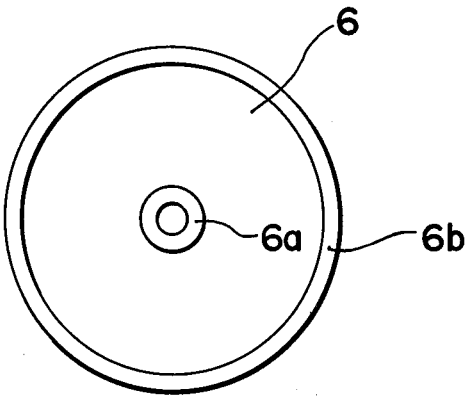
FIG. 4 is a schematic top plan view of a coil support member employed in the arrangement of FIG. 3.

Referring to FIGS. 3 and 4, there is shown a modification of the arrangement of FIG. 2. In the modified exciting arrangement E2 of FIG. 3, the heating coil 3 is further received in a disc-like support member 6 which is made of highly magnetizable material with a high electrical resistance such as ferrite or resin containing ferrite and the like, and which is provided with a central boss portion 6*a* and a peripheral wall 6*b* extending upwardly to a predetermined extent from its outer edge so as to cover the bottom portion and corresponding side edge of said heating coil 3, while the shielding plate member 4 of non-magnetizable metallic material is disposed adjacent to or in contact with the lower portion of said support member 6. Since other constructions of the modified exciting arrangement E2 of FIG. 3 are similar to those of the arrangement E1 of FIG. 2, detailed description thereof is abbreviated here for brevity, with like parts are designated by like reference numerals.

In the modified arrangement of FIGS. 3 and 4, upon passing the high frequency current through the heating coil 3, most of the magnetic lines of flux produced therefrom pass through the coil support member 6, while those leading out of said coil support member 6 are advantageously shielded by the plate member 4.

It should be noted here that, in the modified arrangement E2 of FIG. 3, since it is possible to alter the magnetic reluctance in the passage of the magnetic lines of flux and also the inductance of the heating coil, through adjustments of thickness of the coil support member 6 and the amount of highly magnetizable material contained in said coil support member 6, restrictions in the designing of the arrangement are reduced for a free design selection as desired.

By the above arrangement according to the present invention in which the shielding plate member 4 of non-magnetizable metallic material is disposed outside the bottom portion of the coil support member 6 of highly magnetizable material for covering the heating coil 3, particular advantages as follows may be achieved.

(i) Owing to the provision of the coil support member 6 which covers the bottom portion and peripheral edge portion of the heating coil 3, efficiency for utilization of the magnetic lines of flux is improved.

(ii) The shielding plate member 4, for example, of aluminum also acts as a heat radiating plate, and contributes to improvement of safety operation of the apparatus as considered from the aspect of electrical insulation of the heating coil.

(iii) Shielding effect is further increased by the presence of the shielding plate member 4 of aluminum.

(iv) The advantage available in the above item (iii) makes it possible to reduce the ferrite content in the coil support member 6, and thus, light weight of the heating apparatus has been achieved as well as compact size thereof.

(v) Although the ferrite material for the coil support member 6 is physically weak, the shielding plate member 4 of aluminum provided adjacent thereto or in contact therewith advantageously protects said support member 6.

As is clear from the foregoing description, according to the improved exciting arrangements of the present invention for the induction heating apparatus, particular effects have been achieved such as complete elimination of undesirable heating of the bottom plate, adverse effects to electronic parts, electronic circuits, etc., with a simultaneous reduction of height of the heating apparatus for a compact size.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. An induction heating apparatus of lightweight and reduced size which comprises a top plate for receiving a container of magnetizable material to be heated, and a bottom plate made of an iron material, a heating coil disposed in spaced relationship between the top plate and the bottom plate, said heating coil being provided with a power source for impressing the heating coil with high frequency current, a shielding plate member made of non-magnetizable metallic material disposed in a space between said heating coil and said bottom plate and having a size sufficient to cover the bottom portion of said heating coil, and a coil support member made of highly magnetizable material providing a high electrical resistance, disposed between said heating coil and said shielding plate and covering the bottom portion and the peripheral edge portions of said heating coil for achieving improved magnetic flux efficiency, whereby the magnetic lines of flux produced by said heating coil pass through the coil support member and are radiated by the shielding plate back toward the container.

2. The induction heating apparatus of claim 1, wherein said top plate is made of ceramic material.

3. The induction heating apparatus of claim 1, wherein said bottom plate is made of iron.

4. The induction heating apparatus of claim 1, wherein the shielding plate member is made of aluminum.

5. The induction heating apparatus of claim 4, wherein the shielding plate member has a magnetic reluctance considerably larger than air for preventing magnetic lines of flux produced by said heating coil from passing therethrough.

6. The induction heating apparatus of claim 4, wherein the shielding plate member is so disposed as to act as a heat radiating plate, with simultaneous improvement of the shielding effect.

7. The induction heating apparatus of claim 1, wherein the coil support is made of a ferrite material.

8. The induction heating apparatus of claim 1, wherein the coil support member is made of a resin containing a ferrite material.

9. The induction heating apparatus of claim 1, wherein the coil support member is formed into a circular disc-like configuration having a U-shaped cross section for receiving the heating coil thereon, wherein the support member covers the bottom portion and peripheral side edge portions of said heating coil, said shielding plate member being disposed in contact with the bottom portion of said coil support member so as to protect said coil support member and also to make it possible to reduce the amount of ferrite material for said coil support member through an increased shielding effect provided by said shielding plate member.

10. An induction heating apparatus which comprises a top plate made of ceramic material for receiving a container of magnetizable material to be heated, and a bottom plate made of an iron material, a heating coil disposed in spaced relationship between the top plate and the bottom plate, said heating coil being provided with a power source for impressing the heating coil with high frequency current, a coil support member of highly magnetizable material providing a high electrical resistance, so disposed as to cover the bottom portion and peripheral edge portion of said heating coil for achieving improved magnetic flux efficiency, and a shielding plate member made of non-magnetizable metallic material extending continuously between the support member and the bottom plate, disposed in contact with the bottom surface of said coil support member, and in a spaced relation with respect to said bottom plate so as to allow most of the magnetic lines of flux produced by said heating coil to pass through said coil support member but to shield the magnetic lines of flux leaking out of said coil support member by radiating the magnetic lines of flux toward said container.

* * * * *